United States Patent [19]

Torrejon et al.

[11] 4,125,962

[45] Nov. 21, 1978

[54] GRAVITY SWITCH FOR DOLLS

[76] Inventors: Petra P. Torrejon; D. Francisco Sanchez Sanchez, both of C/Luis de la Torre, Madrid 18, Spain

[21] Appl. No.: 797,325

[22] Filed: May 16, 1977

[51] Int. Cl.[2] ..... A63H 33/26

[52] U.S. Cl. ..... 46/232; 46/175 R

[58] Field of Search ..... 46/264, 265, 266, 268, 46/232, 175 R, 45

[56] References Cited

U.S. PATENT DOCUMENTS

| | | | |
|---|---|---|---|
| 3,162,980 | 12/1964 | Hellman | 46/232 |
| 3,483,655 | 12/1969 | Mason | 46/232 |
| 3,583,093 | 6/1971 | Glass et al. | 46/175 R X |

*Primary Examiner*—F. Barry Shay

*Attorney, Agent, or Firm*—Darby & Darby

[57] ABSTRACT

A gravity-operated electric switch in a figure toy. The switch has a stationary part mounted at the doll periphery, for example, in the doll's head, and a movable part slidably mounted in the stationary part and having a knob permanently projecting exteriorly of the doll. A pull exerted on the projecting end moves electrical contacts on the slidable and stationary parts together closing the switch and operating an electric device, e.g., an acoustic device, within the doll. Releasing the pull allows gravity to open the switch and merely allowing the doll sit or lie undisturbed keeps the electrical device in "off" condition. Thus if the doll is hung up by the knob the device operates, and if it is removed and laid down, operation ceases.

4 Claims, 5 Drawing Figures

GRAVITY SWITCH FOR DOLLS

The present invention refers to an electric switch which works by gravity and which, having manifold applications, is especially designed to be used in different dolls.

In the doll-making industry it is of vital importance to obtain new shapes due to the attraction they involve, and so the switch in question, which achieves an effect unknown until now and with numerous applications, proves a considerable advantage over all dolls known and their systems of working.

The switch consists essentially of a weakly insulated conductor rod, provided with a top knob and a bottom widening, through which shank, and with the limitations implied by the knob and widening, an insulating part can shift freely, inside which a conductor element has been built in, which is put into electrical contact with the rod through the bottom widening of the latter when the shifting part is in its lowest position, and loses contact when it is in any other position.

The rod is connected to a conductor wire and the inner metal part to the insulating part to another conductor wire, so that when both parts connect electrically by the fall of the insulating part, a circuit is closed capable of driving a particular mechanism.

Thus, if the insulating part is fixed, for example to the head of a doll and the rod has free movement with respect to it, when we hang the doll from the knob, the circuit closes, for the doll falls by gravity, and when the doll is supported and not hung, the rod goes down until the knob reaches the doll's head or an organ placed on the said head, whereby the circuit is opened and the effect which it is capable of producing disappears.

Applied to a musical doll, it means that when the doll is hung, the music recorded and gathered in a built-in reproducer plays, while when the doll is supported, for example in the rest position, the music does not play.

Figure 1:
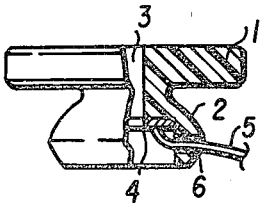

To explain further the foregoing description, and solely by way of example, some drawings are annexed in which the following have been shown:

FIG. 1. Semi-sectioned elevation view of the insulating part.

Figure 2:
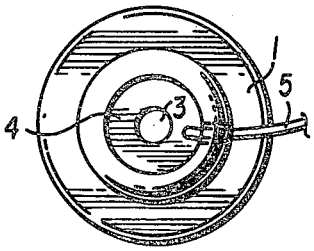

FIG. 2. Plan view of the aforesaid insulating part.

Figure 3:
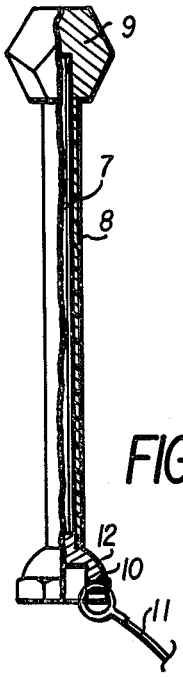

FIG. 3. Semi-sectioned elevation view of the rod.

Figure 4:
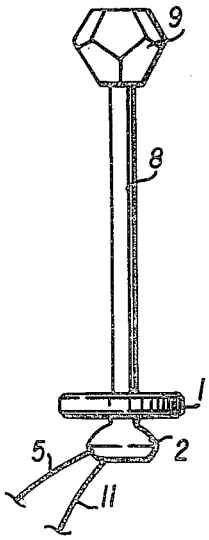

FIG. 4. Closed circuit position.

Figure 5:
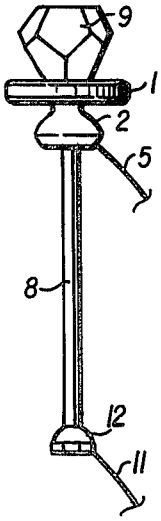

FIG. 5. Open circuit position.

In these figures, the following elements have been marked with their pertinent references:

1. Insulating part.
2. Coupling surface to the doll's head.
3. Drill.
4. Metal washer.
5. Conductor.
6. Drill.
7. Metal rod.
8. Insulating casing.
9. Knob.
10. Drill.
11. Conductor.
12. Lower widening.

The insulating part 1 has a drill 3 which will be crossed in assembly by the rod 7 wrapped in the insulating material 8, and which has a metal washer 4 built-in to which the end of a conductor 5 is fixed, which runs to the said washer 4 through the drill 6 made in the body of the part 1.

For its part, the metal conductor rod 7 is wrapped in an insulating sheet 8 and has the top knob 9 and a lower widening 12, which is drilled to allow the conductor 11 to be fixed, although said conductor 11 can be fixed to the widening 12 by any other means.

With this arrangement, the part 1 is fixed to a doll's head; to assist this, the surface 2 has been provided with the same shape as the head, the latter being housed between the surface 2 and the top plate of the part 1; Before fixing the part 1 in the doll's head, the rod 7 has been arranged so that it crosses the hole 3, whereby the knob 9 will be in the outside part of the doll and the widening 12 inside it. The conductors 5 and 11 are then connected to the pertinent poles of an electrically driven acoustic device, whereby, when the doll is hung from the knob 9, it falls by gravity until the washer 4 comes into contact with the widening 12 to close the circuit and cause the acoustic device to which we referred, to work, and on the other hand, when the doll rests in a supported position and is not hung up, the rod 7 falls until the knob 9 comes to a stop in the doll's head or in the object placed on the head, for example, a hat, so that the washer 4 and the widening 12 are separated, and the circuit open, so that the acoustic device does not work.

We claim:

1. Gravity switch for a doll, characterized by being formed by two complementary parts, of which one is fixed to an organ of the actual doll and preferably to its head, this part being insulating and having a joint metal element connected by a conductor wire to one of the poles of an electrically driven device, while the second part crosses said first part, and can slide freely with respect to it between two limit positions, represented by a top knob and a lower widening, the second part also being metal, with an insulating casing, and being connected by a second wire to the other pole of the electrically driven device, so that when the metal element of the first part and the second part comes into contact, preferably through the lower widening of the latter, the circuit is closed, and the electrically driven device works, whereas when the said metal element of the first part and the second part are separated electrically, the circuit remains open and the device does not work.

2. Gravity switch for a doll as claimed in claim 1, characterized in that the first part has a similar curved surface to the doll's head and a top plate on the curved surface, so that between both a space is left in which the sheet is housed which forms the doll's head, the metal conductor element being a built-in inner washer, and the pertinent conductor wire reaching it by a drill made in the insulating body.

3. Gravity switch for a doll as claimed in claim 1, characterized in that the second part of said first part is a metal rod wrapped in an insulating sheet, except for its ends, of which the top part is housed in an integral knob and the bottom one is a bare widening of the rod itself to which one of the ends of the second conductor wire is fixed by any means.

4. Gravity switch for a doll, as claimed in claim 3, characterized in that in assembly, the insulating part of said first part is fixed to the top part of the doll's head, and is crossed by the rod, so that the bottom bare part of the latter stays inside the doll and the knob placed at the other end remains outside.

* * * * *